United States Patent [19]

Ullman

[11] Patent Number: 4,691,839

[45] Date of Patent: Sep. 8, 1987

[54] SINGLE FINGER-OPENING RESILIENT CAP

[75] Inventor: Myron Ullman, Canfield, Ohio

[73] Assignee: The Dover Molded Products Company, Youngstown, Ohio

[21] Appl. No.: 920,929

[22] Filed: Oct. 17, 1986

[51] Int. Cl.[4] ..... B65D 43/04

[52] U.S. Cl. ..... 220/281; 220/307; 220/DIG. 19; 215/211

[58] Field of Search ..... 220/281, 307, DIG. 19; 215/211, 224, 307, 355

[56] References Cited

U.S. PATENT DOCUMENTS 3,578,193 5/1971 Steiner ..... 215/211

4,413,748 11/1983 Kessler et al. ..... 220/281

*Primary Examiner*—George T. Hall

*Attorney, Agent, or Firm*—Browdy and Neimark

[57] ABSTRACT

A single finger opening collapsible cap, primarily useful for solid medication receptacle closures, includes a first finger-receiving well and a second contractably-biasing well which move relative to one another upon insertion of a single finger within the first finger-receiving well, enabling locking projections disposed on the cap to disengage with a closure opening. The cap is made from a flexible resilient material formed in a one-piece molding operation, and is particularly useful for adults afflicted with arthritis and prevents children from unauthorized access into containers employing this type of closure.

14 Claims, 7 Drawing Figures

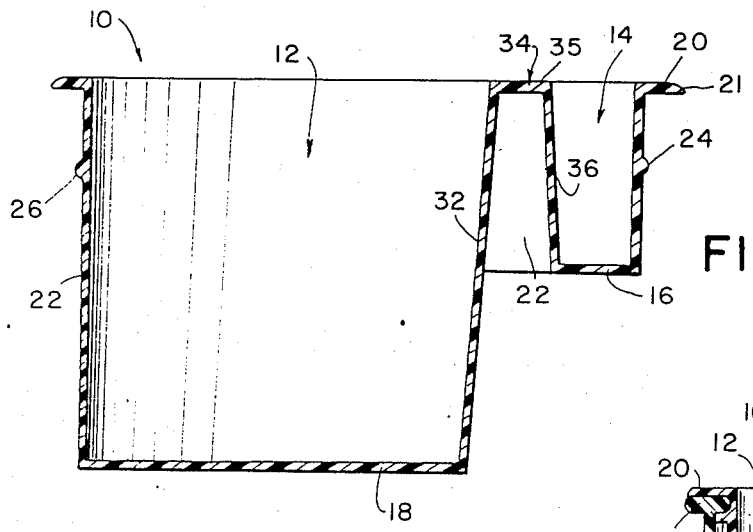
FIG. 4
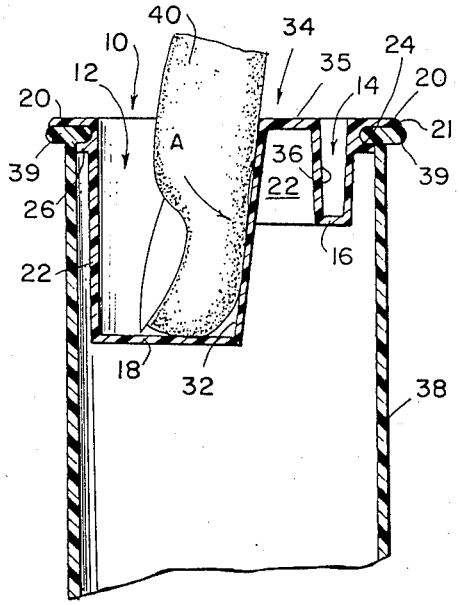
FIG. 5
FIG. 6
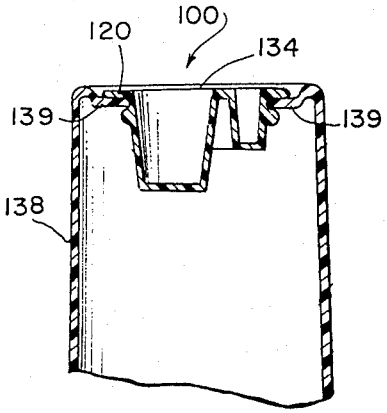
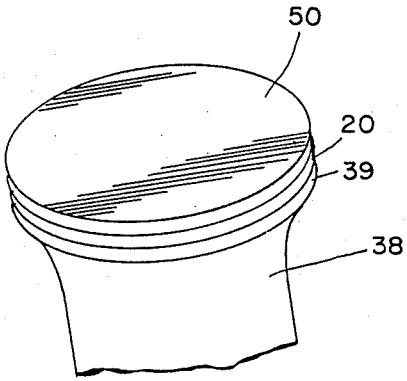
FIG. 7

SINGLE FINGER-OPENING RESILIENT CAP

FIELD OF THE INVENTION

The present invention relates to single finger-opening resilient caps, particularly useful in conjunction with smallnecked pharmaceutical containers such as pill bottles.

BACKGROUND OF THE INVENTION

Single finger-opening collapsible safety closure caps are generally useful for arthritic sufferers needing quick and easy access into medication receptacles and the like. Most of these previously known closures include a finger depressible region for allowing a finger to press the closure, permitting its removal from a container or receptacle. For example, U.S. Pat. Nos. 3,934,745 to Lovell; 4,187,953 to Turner; 4,220,262 to Uhlig et al; and 4,500,006 to Lafortune et al all disclose single finger opening collapsible closures for containers including finger depressible regions to convert the downward force executed by the finger into a disengagement force to remove the closure from the container. However, while these closures facilitate easy single finger removeability, they are not "childproof", and therefore they allow children unauthorized access to a container's contents.

Rubber and other elastic bottle stoppers or plugs have been long known. The U.S. Pat. No. 3,578,193 to Steiner shows such an elastic stopper in the form of a single finger opening closure equipped with a finger receiving well, the closure being removed from a container when finger pressure is applied within the well. Also see Bramming U.S. Pat. No. 2,746,632. Unfortunately, due to the closure's elasticity, changes in ambient temperatures may cause the premature opening of a container utilizing these types of closures. Additionally, elastic closures per se, typically used in conjunction with laboratory test tubes and the like, are relatively expensive to mass produce because of compounding requirements and the necessity of using relatively large quantities of material. Other disadvantages of elastic stoppers when employed in the pharmaceutical packaging industry include the fact that they are usually formed of compounded materials, components of which may cause contamination, or eventual degradation.

The U.S. Pat. No. 4,413,748 to Kessler et al discloses a double finger-collapsible closure equipped with a pair of spaced, D-shaped, finger receiving wells for permitting the removal thereof upon finger pinching motion executed within the wells. This cap is preferably formed as a one-piece molded structure, utilizing a resilient thermoplastic material, such as polyethylene or polypropylene, which does not readily deform or dis-shape when exposed to increased ambient temperatures. Furthermore, this cap is childproof as a child's attempt to deform or rotate a closure of this type would be very difficult, deterring further attempts of unauthorized access. However, this construction, because of having two finger wells, is often not suitable for smaller containers such as bottles.

Containers for keeping potentially dangerous solid materials, such as medicines, must be provided with closures which are easy to install and remove, and which will securely retain the solid materials within their containers. Closures must be operable with sufficient ease to assure that container contents are not inadvertently spilled or otherwise discharged during closure installation or removal.

It is desirable that closures for dangerous material containers be "childproof" in the sense that at least two distinct types of movements must be performed in proper sequence to effect closure removal. Furthermore, it is desirable that such closures have relatively simple configurations which can be molded easily from relatively inexpensive plastic materials. Additionally, it is desirable that such closures be characterized by smooth lines which provide an aesthetically pleasing appearance. Additionally in some instances there is a need to provide closures which will prevent pressure buildups by venting gases from within a container.

Except for Kessler U.S. Pat. No. 4,413,748, previously proposed container closure caps have not adequately addressed the foregoing needs. Many are either undesirably difficult to operate, or they close insecurely. Many are of unduly complex configuration, have unattractive appearances, and/or are undesirably expensive to mold from plastic materials. Most fail to address the need for a gas venting capability.

No single finger-opening resilient cap has previously been available which will not readily deform or dis-shape due to increased ambient temperatures, which will further prevent an unauthorized child's access, and will provide an easy removable closure for adults, especially adults afflicted with arthritis. Furthermore, there is a need for a closure or cap of this type, especially when utilized in conjunction with pill containers and which will eliminate the need for cotton fillers usually provided to maintain solid medicines stationary within their containers.

SUMMARY OF THE INVENTION

Accordingly, it is an object of the present invention to overcome the deficiencies of the prior art, such as those indicated above.

It is a further object of the present invention to provide for improved closure of medicine bottles.

It is another object to provide an improved single finger-opening resilient cap made from resilient thermoplastic materials.

It is still another object of the present invention to provide a single-finger opening resilient cap which, when employed as a pharmaceutical container closure, will prevent unauthorized access by children to the container's contents.

It is another object of the present invention to provide a single-finger opening resilient cap which will not readily disform or dis-shape when exposed to elevated ambient temperatures.

It is still another object of the present invention to provide a single-finger opening resilient cap including a deep cavity that will eliminate the need for cotton filler usually provided to maintain solid medicines stationary within containers employed as pharmaceutical receptacles.

It is another object of the present invention to provide a single-finger opening resilient cap which is simple and inexpensive to manufacture on a high volume basis.

It is still another object of the present invention to provide a single-finger opening resilient cap having simple and quick removeability, particularly for adults afflicted with arthritis or the like.

Still other objects, features and attendant advantages of the present invention will become apparent to those skilled in the art from a reading of the following detailed description of embodiments of the invention accordance therewith, taken in conjunction with the accompanying drawings, wherein:

BRIEF DESCRIPTION OF THE DRAWINGS

FIG. 4 is a cross-sectional view of the single-finger opening resilient cap taken along the line 4—4 in FIG. 2;

FIG. 5 is a cross-sectional view of the single-finger opening collapsible cap taken along the line 4—4 in FIG. 2, showing the use thereof in conjunction with pharmaceutical receptacles and simulating a method of single finger opening removal of the cap from the receptacle.

FIG. 6 is a cross-sectional view similar to FIG. 5, showing another embodiment; and FIG. 7 is a partial perspective view provided with a tamper-proof seal.

DESCRIPTION OF PREFERRED EMBODIMENT

Figure 1:
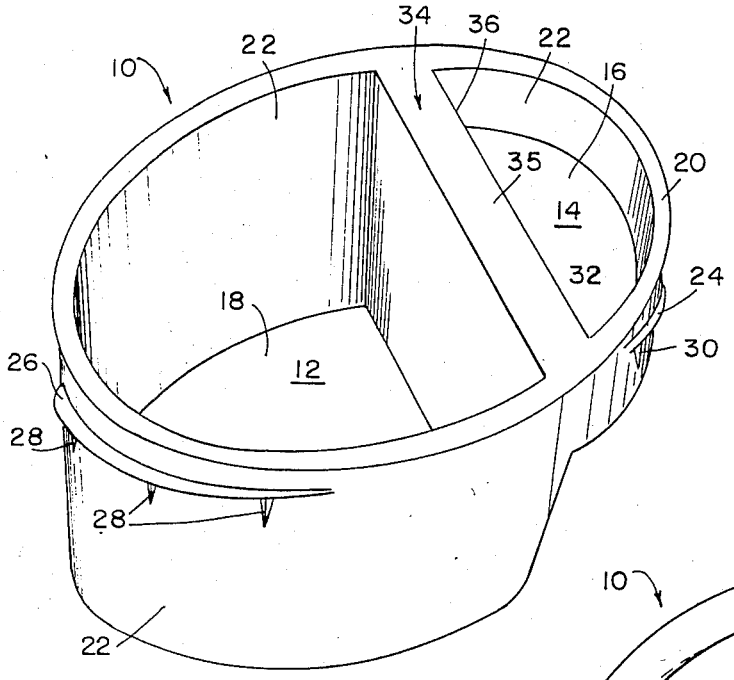
FIG. 1 is a perspective view of a single-finger opening resilient cap according to the present invention.

A presently preferred embodiment of a molded resilient cap 10 according to the present invention is illustrated in FIG. 1 of the drawings. The resilient cap 10 has a sturdy thin-walled construction preferably formed from a resilient thermoplastic material, such as polyethylene or polypropylene or the like, and includes a top wall 34 with edge portions which form a somewhat downwardly-turned, circumferentially-extending rim 20. The cap 10 also includes a first, D-shaped, finger-receiving well 12 and a second, D-shaped, substantially smaller, contractably-biasing well 14, both wells 12 and 14 extending downwardly from the top wall 34, such top wall 34 including a bar shaped portion 35 which extends between the flat side walls 32,36 of the wells 12 and 14, separating the wells from one another.

The cap 10 is provided with a generally circular side wall 22 which makes a line of connection with the top wall 34 at a location which is inset from the circular outer edge of the rim 20. Side wall 22 is equipped with two, diametrically-opposing sets of locking cams or ribs 24,26, both having a plurality of spaced, tapered guide projections 28 and 30, respectively, therebeneath.

Figure 2:
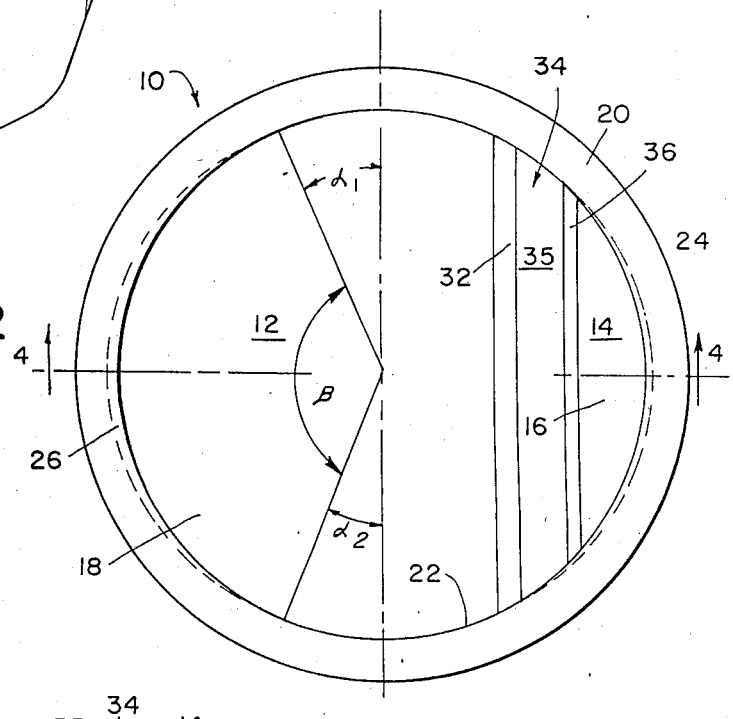
FIG. 2 is a plan view of the single-finger opening resilient cap of FIG. 1.
Figure 3:
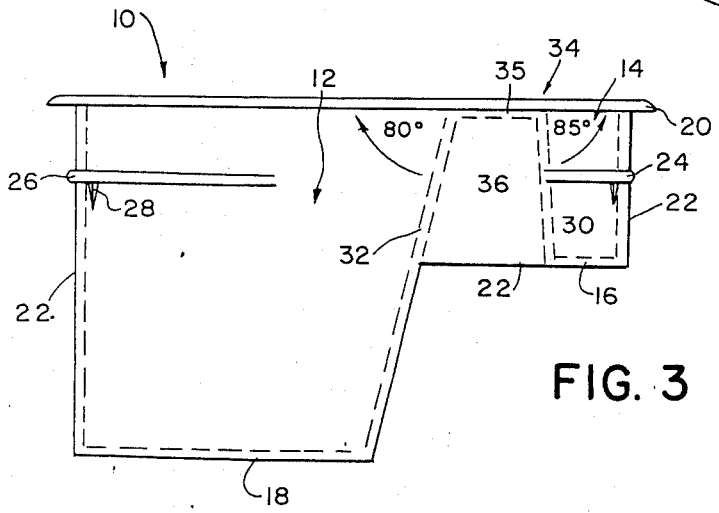
FIG. 3 is a elevational view of the single-finger opening resilient cap of FIGS. 1 and 2.

As can best be seen in FIGS. 2–4, the finger-receiving well 12 includes a bottom wall 18, and likewise the second contractably biasing well 14 includes a bottom wall 16. It should be understood that first finger-receiving well 12 is approximately twice as deep as second well 14 in the illustrated embodiment, although other variations in well depth size could also be employed, the height of the bottom wall 18 serving to control the internal volume of the bottle being capped in much the manner of the usual cotton wad. As best illustrated in FIG. 2, the finger well 12 is also approximately three times the width of the second well 14, although again other variations in well width size could also be employed.

Referring now to FIGS. 3 and 4, the locking rib or projection 26 and its respective tapered guide projections 28 are located in the illustrated embodiment approximately, from top to bottom, one-fifth the distance between the top wall 34 and the bottom wall 18. It will be understood, however, that this dimension is selected bearing in mind the height of the lip of the bottle to be capped, so that the rib 26 will fit under the bottle bead. Likewise, the locking rib or projection 24 and its respective tapered guide projections 30 are located in the same plane parallel to the top wall 34; in the illustrated embodiment this is approximately, from top to bottom, one-half the distance between the top wall 34 and the bottom wall 16. As indicated above, the vertical distance between the rim 20 and the locking ribs 24 and 26 is fixed by the height of the lip of the bottle to be sealed by the cap 10.

The locking projections 24 and 26 are desirably identical to one another in wedge shape, although the locking projection 26 may be somewhat longer than the projection 24 as illustrated. Looking at FIG. 2, it will be seen that the locking rib or projection 26, which also acts as a caming surface, ideally extends about 135° (angle $\beta$) starting with a width of 0 and progressively increasing to a point 67.5° from the start, and then progressively decreasing again to 0. In other words, from the widest point of the cap, the rib 26 begins at a point defined by the angles $\alpha 1$ and $\alpha 2$, and these angles are preferably no less than 22.5°, although they may be somewhat greater. The same general rule applies to the rib 24, although this rib is preferably shorter than the rib 26 as pointed out above.

The locking projections 24,26 and their respective tapered guide projections 28,30 are utilized to maintain the cap 10 in a locking position when lodged in a closure opening, it being understood that the guide projections 28,30 serve as ramps to enable the cap 10 to flex as the internal closure lip of the bottle opening presses against the guide projections, causing inward compression of the cap during placement of the cap 10 on and in the neck of the bottle being sealed. It should also be noted that the spaced tapered guide projections 28,30 are perpendiculary-aligned integrally with the locking projections 24,26.

As can best be seen in FIGS. 2 and 3, the first finger receiving well 12 includes the slanted, generally planar side wall 32 which is positioned between, from top to bottom, the bar shaped portion 35 and the bottom wall 18, and in a plane at an angle of preferably at least 75° and at most 89° relative to the plane defined by the cap's top wall 34. As shown in FIG. 3, the side wall 32 is in a plane at an angle of about 80° relative to the plane defined by the cap's top wall 34. This facilitates the best deformation characteristics when finger pressure is exerted against side wall 32, permitting cap 10 to be easily removed from a container's neck opening.

Likewise, the second contractably-biasing well 14 includes the slanted side wall 36 which is positioned between, from top to bottom, the bar shaped portion 35 and the bottom wall 16, in a plane at an angle of preferably at least 80° and at most 89° relative to the plane defined by the cap's top wall 34. Again, as shown in FIG. 3, the side wall 36 is in a plane at an angle of about 85° relative to the plane defined by the cap's top wall 34. It should be understood that side wall 32 of first finger receiving well 12 should always be in a plane having a lesser degree of an angle relative to the plane defined by the cap's top wall 34 than the angle defined between the second well's side wall 36 and the cap's top wall 34, and in the opposite direction; in other words, the side wall 32 should be slanted greater than and opposite to the side wall 36.

Referring now to FIG. 5 of the drawings, cap 10 is shown as a closure for a solid pharmaceutical receptacle 38 having a circular opening with a conventional flanged rim 39 for receiving and mating with the locking projections 24 and 26 of the cap 10. The cap's rim 20 has a somewhat downwardly extending pointed edge 21 which is configured to provide a rounded outer surface that is not easily engaged by one's fingernail, whereby the likelihood of a person (such as a child) being able to grasp the rim 20 to remove the cap 10 from the container 38 is essentially eliminated.

As shown in FIG. 5, the cap 10 is readily removable from the container opening by inserting a single finger 40 within the finger receiving well 12. As illustrated by the direction of the arrow A, finger pressure is exerted against side wall 32 causing at least the locking projection 26 to move sufficiently inwardly with respect to the receptacle opening to thereby release from its engagement with the receptacle so that the cap 10 can be lifted out of the receptacle opening. The finger force as illustrated in FIG. 5 effectively causes the cap structure to pivot about the second well 14 to allow the rib 26 to clear the bottle bead, thereby permitting disengagement of the cap 10 from the receptacle lip. It should be understood that as finger force is exerted on the side wall 32, the bar shaped portion 35 and the side wall 36 of the second well 14 contractably deform, yet return to their original or normal configuration once finger pressure against side wall 32 is released. To complete the removal of the cap 10, the finger continues its arc-like motion resulting in a lifting upwardly of the cap 10.

The amount of removal force or the force exerted by the finger can be adjusted by varying the length of the locking projections 24,26 positioned below the cap's rim or edge 20,21. The amount of force required is also a function of the depth and inclination of the wall 32, and the flexibility of the cap walls. If desired, the wall 32 may be roughened or provided with horizontal ridges to improve finger contact during the final upward finger thrust to remove the cap. The finger force exerted against side wall 32 is somewhat different from the "pinch" or "pinching" motion used in Kessler et al U.S. Pat. No. 4,413,748, as "pinching" connotes the use of at least two fingers, whereas the present invention needs only the use of one finger to release the closure, a feature of invention especially beneficial for adults afflicted with arthritis.

Due to the depth of the finger receiving well 12, the use of cotton fillers usually utilized with solid medicament receptacles is advantageously eliminated. The cap's first well 12 will easily maintain pills or the like stationary within the receptacle 38 during transport, etc. The cap 10 can also be provided with venting grooves (not shown) for venting gases which may build up within a container closed by the cap. Furthermore, the cap 10 can be provided with a paper disk adhesively secured to the cap's top wall 34 to act as a tamperproof seal, as well as providing space for written instructions detailing opening procedures.

FIG. 6 shows a variation 100 usable on a bottle 138 with a modified opening including a recessed lip 139. With this embodiment, the top wall 134 and the rim 120 lie below the upper edge of the bottle 138. It is consequently impossible to attempt to remove the cap by the use of one's teeth, and therefore this structure provides an added child-proofing element.

FIG. 7 shows the addition of a tamper-proof disk or cover 50 to the top of the cap, and the disk or cover 50 can be adhesively adhered to the rim 20 and the top wall 35. A simple paper disk can adequately serve for the tamper-proof cover 50, and it can be imprinted with suitable directions, advertising, etc. In place of the paper disk, a shrinkable plastic or the like may cover the top, or the paper disk may be used together with the shrinkable plastic, such a shrinkable plastic covering the paper disk 50, the rim 20 of the cap, and the rim 39 of the bottle 38.

While such orientation words as "top," "bottom", "upward", downward" and the like are utilized herein, it will be understood that the cap of the present invention may be positioned in attitudes different from those described and illustrated. Accordingly, it will be understood that such orientation words as are utilized herein are intended to facilitate an understanding of the relative orientation of various components and are not to be construed as limiting.

It will be obvious to those skilled in the art that various other changes and modifications may be made without departing from the scope of the invention and therefore the invention is not to be considered limited to what is shown in the drawings and described in the specification.

What is claimed is:

1. A single finger opening resilient cap for insertion into a container opening to releasably close the opening, comprising:

a top wall with edge portions which form a rim having a size which is greater than that of a container opening that is to be closed by the cap, said rim being configured to overlay container portions which surround the container opening, said top wall defining a first plane;

a finger-receiving well formed in said top wall, including a bottom wall and a slanted side wall extending between said top wall and said bottom wall, said slanted side wall defining a second plane disposed at an angle relative to said first plane, said well being of size sufficiently large to receive therewithin a finger;

a contractably-biasing well formed in said top wall including a bottom wall at a level higher than the bottom wall of said finger receiving well, and a slanted side wall extending between said top wall and said bottom wall, said slanted side wall defining a third plane disposed at an angle relative to said first plane, said contractably-biasing well being smaller than said finger-receiving well;

a circumferentially-surrounding side wall portion which depends from said top wall at locations inset from said rim and which forms at least part of the walls of said wells;

locking means carried on said circumferentially-surrounding side wall portion for engaging said closure opening;

whereby single finger force exerted on said slanted side wall within said finger-receiving well will deform said cap thereby disengaging said locking means from said closure opening and thereby releasing said cap from said closure opening.

2. A single finger opening resilient cap in accordance with claim 1, wherein said cap is formed from a one-piece, resiliently deformable structure molded from resilient plastic material and which has a memory that tends to return said cap to its normal configuration if said cap has been deformed.

3. A single finger opening resilient cap in accordance with claim 2, wherein said resilient plastic material comprises polyethylene or polypropylene.

4. A single-finger opening resilient cap in accordance with claim 1, wherein said finger-receiving well and said contractably-biasing well are separated by a bar-shaped portion of said top wall.

5. A single finger opening resilient cap in accordance with claim 1, wherein said finger-receiving well is at least about twice as deep as said contractably-biasing well.

6. A single finger opening resilient cap in accordance with claim 1, wherein said finger-receiving well is about three times the width of said contractably-biasing well.

7. A single finger opening resilient cap in accordance with claim 1 wherein said angle of said slanted side wall defining a second plane relative to said first plane, in said finger-receiving well, is at least 75° and at most 89°; and said angle in said contractably-biasing well is at least 80° and at most 89° relative to said first plane.

8. A single finger opening resilient cap in accordance with claim 1, wherein said locking means comprises a pair of oppositely spaced semi-circular ridges extending outwardly from said circumferentially-surrounding side wall, and said locking means further includes a plurality of spaced perpendicularly aligned tapered guide projections extending downwardly from said ridges.

9. A single finger resilient cap according to claim 8, wherein one of said semi-circular ridges is longer than the other.

10. A single finger opening resilient cap in accordance with claim 1, wherein said first finger-receiving well is of substantially D-shaped configuration.

11. A single finger opening resilient cap in accordance with claim 1, wherein said second contractably-biasing well is of substantially D-shaped configuration.

12. A single finger opening resilient cap in accordance with claim 1, wherein the angle of inclination of said slanted side wall of said finger-receiving well is greater than the angle of inclination of the slanted side wall of the contractably-biasing well.

13. A single finger opening resilient cap according to claim 8 wherein one of said oppositely spaced semi-circular ridges extends in an arc not exceeding 135° about the exterior of said finger-receiving well, said ridge becoming progressively thicker to a point of maximum thickness along a line perpendicular to said slanted side wall and opposite thereof.

14. A single finger opening resilient cap in accordance with claim 1 having a tamper-proof seal thereover.

* * * * *